US005473829A

United States Patent [19]

Adrian et al.

[11] Patent Number: 5,473,829

[45] Date of Patent: Dec. 12, 1995

[54] EARTHWORKING MACHINE CUTTING ELEMENT HAVING CARBIDE INSERT AND METHOD FOR FORMING THE CUTTING ELEMENT

[75] Inventors: Richard L. Adrian, Dunlap; Phillip J. Shankwitz, Peoria, both of Ill.

[73] Assignee: Caterpillar Inc., Peoria, Ill.

[21] Appl. No.: 260,297

[22] Filed: Jun. 14, 1994

[51] Int. Cl.[6] ..... E02F 9/28; E02F 3/76

[52] U.S. Cl. ..... 37/446; 37/460; 172/772.5

[58] Field of Search ..... 37/446, 447, 448, 37/450, 451, 452, 453, 455, 460, 465; 172/699, 701.3, 713, 719, 767, 772.5, 797; 299/86, 91, 92, 95

[56] References Cited

U.S. PATENT DOCUMENTS

| | | | |
|---|---|---|---|
| 2,739,395 | 3/1956 | Stratton | 37/460 X |
| 4,086,966 | 5/1978 | Lanz et al. | 37/460 X |
| 4,187,626 | 2/1980 | Greer et al. | 172/719 X |
| 4,262,753 | 4/1981 | Vanchot | 172/701.3 X |
| 4,608,318 | 8/1986 | Makrides et al. | 428/553 |
| 4,817,743 | 4/1989 | Greenfield et al. | 175/411 |
| 5,081,774 | 1/1992 | Kuwano | 37/460 |
| 5,224,555 | 7/1993 | Bain et al. | 172/719 X |

*Primary Examiner*—Dennis L. Taylor
*Assistant Examiner*—Robert Pezzuto
*Attorney, Agent, or Firm*—Frank L. Hart

[57] ABSTRACT

A carbide insert having fracture orienting grooves and a method for forming a cutting element for an earthworking machine. The carbide insert is placed in a groove formed on the cutting edge of the cutting element and there maintained by deforming walls of the cutting element into intimate contact with the carbide insert.

30 Claims, 3 Drawing Sheets

EARTHWORKING MACHINE CUTTING ELEMENT HAVING CARBIDE INSERT AND METHOD FOR FORMING THE CUTTING ELEMENT

TECHNICAL FIELD

The present invention relates to earthworking machines and more particularly to earthworking machines having a cutting element having a carbide insert and the method for forming the cutting element.

BACKGROUND ART

The earthworking machinery industry has for years experienced problems in generating cutting equipment which will have a long life. It is well known in the industry that equipping the edge of a cutting element with carbide inserts improves the useful life of the cutting element. However, this heretofore utilized practice is labor intensive in positioning the carbide inserts relative to the cutting element and there maintaining them until bonded or otherwise fixedly connected to the element.

One heretofore utilized practice of Caterpillar Inc. was to cut a groove in the edge of the cutting element, place the carbide inserts in the groove and then deform the walls of the cutting element groove into forcible contact with the inserts. It was discovered in utilizing this method that if the inserts were not kept extremely short in length, about one inch, that the carbide inserts were cracked and broken after deformation and sometimes further broken after use of the cutting element.

Analysis disclosed that the cracking and breaking of the inserts occurred in a multiplicity of different directions relative to the longitudinal axis of the insert. After breakage of the insert and after the walls of the cutting element became worn, these broken off pieces, which were sometimes relatively large, would be released and disengage from the cutting element.

This labor intensive operation and the breakage and loss of insert portions represented a waste of manpower, material, natural resources, and down time for the machine.

The present invention is directed to overcome one or more of the problems as set forth above.

DISCLOSURE OF THE INVENTION

In one aspect of the invention, a method is provided for forming an elongated cutting element for an earthworking machine. The cutting element has an elongated carbide element extending along the cutting edge of the cutting element. An elongated groove is formed of preselected dimensions along the cutting edge of the cutting element. An elongated carbide insert having a length greater than one foot is provided. The insert has a longitudinal axis and grooves angularly oriented relative to the insert axis and extending a preselected distance about the periphery of the insert and spaced preselected distances one from the other. The carbide insert is placed within the elongated groove, heated to a preselected temperature and the groove walls of the cutting element are then deformed into contact with the carbide insert.

In another aspect, the invention is directed to the carbide insert for association with a cutting edge of an elongated cutting element of an earth working machine. The elongated carbide insert has a longitudinal axis and a plurality of grooves angularly oriented relative to the insert axis and extending a preselected distance about the periphery of the insert spaced preselected distances from one another.

BEST MODE FOR CARRYING OUT THE INVENTION

Figure 1:
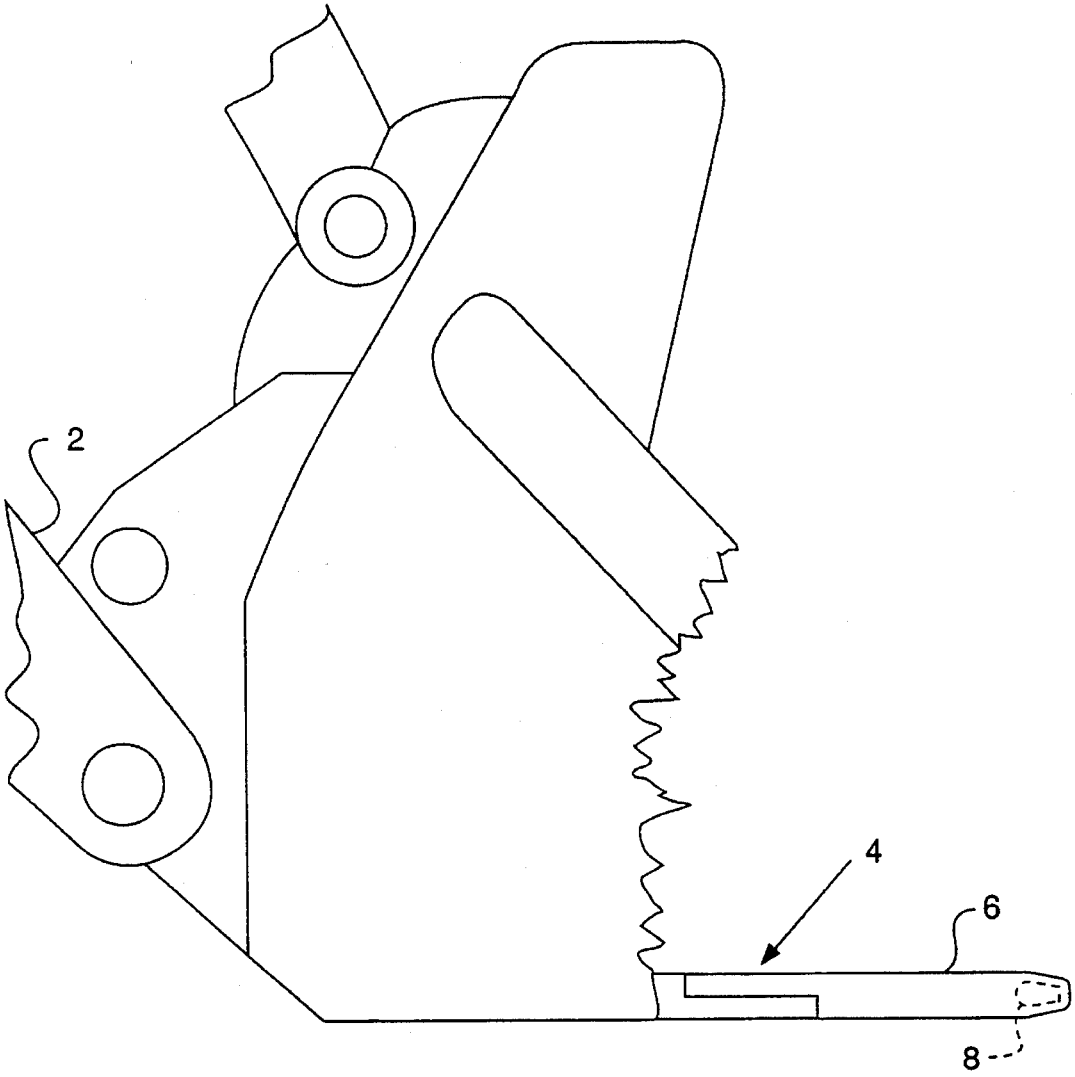
FIG. 1, is a diagrammatic partial side view of a cutting element of an earthworking machine having the carbide insert of this invention.

Referring to FIG. 1, an earthworking machine 2, for example a motor grader or loader, has a blade or bucket 4 which has a cutting element 6 connected on the forward edge of the blade 4. As shown in phantom, the cutting element 6 has a carbide insert 8 encapsulated therewithin.

Figure 2:
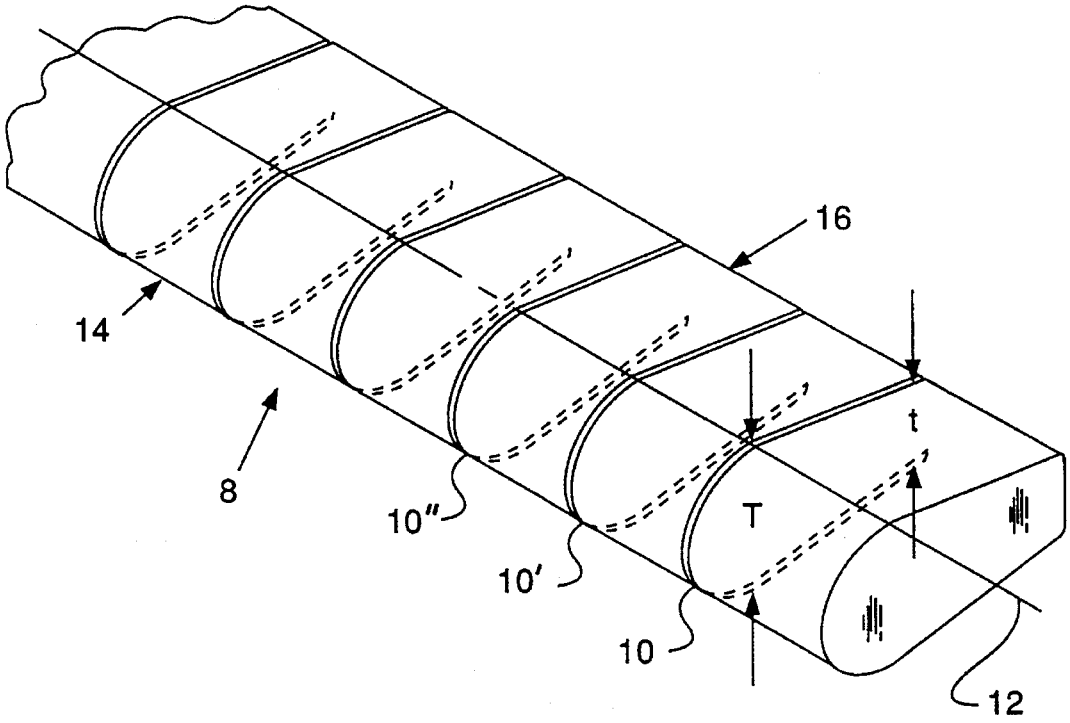
FIG. 2 is a diagrammatic view of the elongated carbide insert of this invention.

Referring to FIG. 2, the carbide insert is elongated and has a length greater than about 1 foot. It has been discovered that if the inserts are not greater than about one foot in length that the process remains labor intensive and undesirable waste is still present.

Grooves 10 are formed in the insert 8 and preferably extend transverse the longitudinal axis 12 of the insert 8 and about the outer periphery a preselected distance. The grooves are spaced a preselected distance one from the other.

The grooves 10 preferably extend completely around the insert 8, but some control of cracking and breaking has been discovered to be beneficial if the grooves 10 extend at least about 75% of the peripheral distance.

The grooves 10 are space one from an adjacent insert groove 10',10" a linear distance in the range of about ¼ inch to about 2 inches, as measured along the axis 12 of the insert 8. More preferably, the space between insert grooves 10,10' is about 1 inch. It should be understood however that this invention contemplates groove spacing which varies and grooves 10 which are angularly oriented relative to the axis 12.

Figure 3:
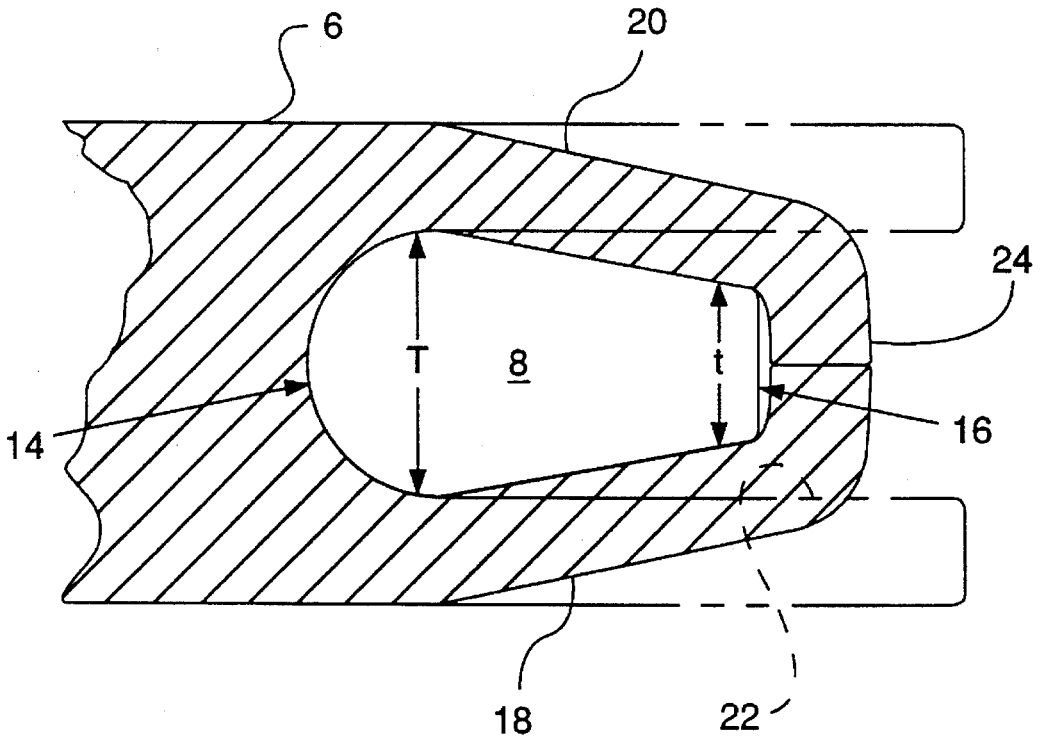
FIG. 3 is a diagrammatic view in cross section showing one embodiment of the carbide insert encapsulated within the cutting element.

Referring to FIGS. 2 and 3, the carbide insert 8 has rearward and forwarded edges 14,16. The rearward edge 14 preferably is of greater thickness "T" than the thickness "t" of the forward edge 16. As can be seen in the drawings, it is preferred that the rearward edge 14 also be of arcuate or domed configuration in order to interfere less with the hereafter more fully described deformation of the walls 18,20 of the cutting element groove 22.

INDUSTRIAL APPLICABILITY

In the method of this invention, an elongated groove 22 of preselected dimension is formed along the cutting edge 24 of the cutting element 6 by methods well known in the art. The carbide insert 8 is positioned within the cutting element groove 22 with the rearward edge 14 of the carbide insert 8 immediately adjacent the bottom of the cutting element groove 22.

The cutting element 6 containing the insert 8 are then heated to a preselected temperature and thereafter the walls 18,20 of the cutting element 6 are deformed into contact, preferably intimate contact, with the carbide insert 8. More preferably, the cutting element groove 22 is of sufficient depth that the cutting element walls 18,20 extend beyond the insert 8 and during deformation of the walls 18,20 are urged together thereby encapsulating the insert 8 within the cutting element 6.

By utilizing the method of this invention with the carbide insert of this invention, cracking and breaking of the carbide insert 8 during deformation and/or use is controlled in a direction which dramatically reduces the loss of insert portions during wear of the assembly.

The temperature and method of heating can be selected by the user after the material of the cutting element is selected. Such heating is well known in the art. The wall deformation can also be by various well known means. However a preferred method utilizes a selective forming machine which is well known and patented by Caterpillar Inc.

Other aspects, objects and advantages of this invention can be obtained from a study of the drawings, the disclosure and the appended claims.

What is claimed is:

1. A method for forming an elongated cutting element for an earthworking machine, said cutting element having an elongated carbide element extending along the cutting edge of said cutting element, comprising:

forming an elongated groove of preselected dimensions along said cutting edge of the cutting element;

providing an elongated carbide insert having a longitudinally extending axis, a length of greater than 1 foot and grooves angularly oriented relative to the insert longitudinal axis and extending a preselected distance about the periphery with said grooves spaced preselected distances one from the other;

inserting the carbide insert within the elongated groove;

heating to a preselected temperature the cutting element having the carbide insert; and deforming walls of the groove into contact with the carbide insert.

2. A method, as set forth in claim 1, wherein the grooves in the carbide insert extend about the periphery a distance of at least 75% of the peripheral distance.

3. A method, as set forth in claim 2, wherein said grooves extend completely about said periphery.

4. A method, as set forth in claim 1, wherein at least a portion of the insert grooves are spaced one from an adjacent insert groove a linear distance in the range of about ¼ inch to about 2 inches.

5. A method, as set forth in claim 4, wherein at least a portion of the insert grooves are spaced from adjacent insert grooves a distance of about 1 inch and extend transverse the insert longitudinal axis.

6. A method, as set forth in claim 1, wherein the groove walls of the walls of the element are deformed into intimate contact with the carbide insert.

7. A method, as set forth in claim 1, wherein the ends of the element walls of said groove are deformed into contact with one another and the carbide insert is encapsulated within the cutting element.

8. A method, as set forth in claim 1, wherein the carbide inset has rearward and a forward edges, said rearward edge being of a greater thickness "T" than the thickness "t" for the forward edge and including inserting the carbide insert into the cutting element groove with the rearward edge of the insert immediately adjacent the bottom of the groove.

9. An elongated carbide insert for association with a cutting edge of an elongated cutting element of an earth working machine, comprising:

said elongated carbide insert having a longitudinally extending axis, a plurality of grooves angularly oriented relative to the longitudinal axis and extending transverse the longitudinal axis of the insert and having forward and rearward edges, said insert grooves extending a preselected distance about the periphery of the insert and being spaced preselected distances one from another.

10. An insert, as set forth in claim 9, wherein the grooves transversely extend about the periphery a distance of at least 75% of the peripheral distance.

11. An insert, as set forth in claim 10, wherein the grooves extend completely about said periphery.

12. An insert, as set forth in claim 9, wherein the grooves are spaced from an adjacent groove a linear distance in the range of about ¼ inch to about 2 inches.

13. An insert, as set forth in claim 12, wherein at least a portion of the grooves are spaced from adjacent grooves a distance of about 1 inch.

14. An insert, as set forth in claim 9, wherein the rearward edge is of greater thickness "T" than the thickness "t" of the forward edge of the insert.

15. An insert, as set forth in claim 9, wherein the elongated carbide insert has a length of at least 1 foot.

16. An insert, as set forth in claim 9, wherein the rearward edge of the carbide insert is of arcuate cross sectional configuration.

17. A method for forming an elongated cutting element for an earthworking machine, said cutting element having an elongated carbide element extending along the cutting edge of said cutting element, comprising:

forming an elongated groove of preselected dimensions along said cutting edge of the cutting element;

providing an elongated carbide insert having a longitudinally extending axis, a length of greater than 1 foot and grooves angularly oriented relative to the insert longitudinal axis and extending a preselected distance about the periphery with said grooves spaced preselected distances one from the other, said carbide insert having rearward and forward edges, said rearward edge being of a greater thickness "T" than the thickness "t" of the forward edge and including inserting the carbide insert into the cutting element groove with the rearward edge of the insert immediately adjacent the bottom of the groove.

18. A method, as set forth in claim 17, wherein the grooves in the carbide insert extend about the periphery a distance of at least 79% of the peripheral distance.

19. A method, as set forth in claim 18, wherein said grooves extend completely about said periphery.

20. A method, as set forth in claim 17, wherein at least a portion of the insert grooves are spaced one from an adjacent insert groove a linear distance in the range of about ¼ inch to about 2 inches.

21. A method, as set forth in claim 20, wherein at least a portion of the insert grooves are spaced from adjacent insert grooves a distance of about 1 inch and extend transverse the insert longitudinal axis.

22. A method, as set forth in claim 17, wherein the groove walls of the element are deformed into intimate contact with the carbide insert.

23. A method, as set forth in claim 17, wherein the ends of the element walls of said groove are deformed into contact with one another and the carbide insert is encapsulated within the cutting element.

24. An elongated carbide insert for association with a cutting edge on an elongated cutting element of an earth working machine, comprising:

said elongated carbide insert having a longitudinally extending axis, a plurality of grooves angularly oriented relative to the longitudinal axis and extending transverse the longitudinal axis of the insert and having forward and rearward edges, said insert grooves extending a preselected distance about the periphery of the insert and being spaced preselected distances one from another, said rearward edge of the carbide insert being of arcuate cross sectional configuration.

25. An insert, as set forth in claim 24, wherein the grooves transversely extend about the periphery a distance of at least 75% of the peripheral distance.

26. An insert, as set forth in claim 25, wherein the grooves extend completely about said periphery.

27. An insert, as set forth in claim 24, wherein the grooves are spaced from an adjacent groove a linear distance in the range of about ¼ inch to about 2 inches.

28. An insert, as set forth in claim 27, wherein at least a portion of the grooves are spaced from adjacent grooves a distance of about 1 inch.

29. An insert, as set forth in claim 24, wherein the elongated carbide insert has a length of at least 1 foot.

30. an insert, as set forth in claim 24, wherein the rearward edge of the carbide insert is of arcuate cross sectional configuration.

* * * * *

UNITED STATES PATENT AND TRADEMARK OFFICE

CERTIFICATE OF CORRECTION

PATENT NO. : 5,473,829

DATED : December 12, 1995

INVENTOR(S) : Richard L. Adrian et al.

It is certified that error appears in the above-identified patent and that said Letters Patent is hereby corrected as shown below:

Claim 6, column 3, line 52 after "walls", delete "of the walls".

Signed and Sealed this

Fourteenth Day of May, 1996

*Attest:*

Bruce Lehman

BRUCE LEHMAN

*Attesting Officer*

*Commissioner of Patents and Trademarks*